US005129329A

United States Patent [19]

Clasen

[11] Patent Number: 5,129,329

[45] Date of Patent: Jul. 14, 1992

[54] CORRUGATED CARDBOARD PALLET

[76] Inventor: Hank A. Clasen, 29427 Summit Ridge, Fair Oaks Ranch, Tex. 78006

[21] Appl. No.: 592,631

[22] Filed: Oct. 4, 1990

Related U.S. Application Data

[63] Continuation-in-part of Ser. No. 567,301, Aug. 14, 1990, Pat. No. 5,076,176.

[51] Int. Cl.[5] ..... B65D 19/00

[52] U.S. Cl. ..... 108/51.3; 108/52.1

[58] Field of Search ..... 108/51.3, 52.1, 57.1, 108/51.1

[56] References Cited

U.S. PATENT DOCUMENTS

| | | | |
|---|---|---|---|
| 2,388,730 | 11/1945 | Fallert | 248/120 |
| 2,432,295 | 12/1947 | Donahue | 108/52.1 |
| 2,501,506 | 3/1950 | George | 248/120 |
| 3,055,624 | 9/1962 | Wilson | 248/120 |
| 3,464,371 | 9/1969 | Gifford | 108/57 |
| 3,557,719 | 1/1971 | Gielas | 108/56 |
| 4,424,753 | 1/1984 | Eatherton | 108/56.1 |
| 4,454,946 | 6/1984 | Yokowo | 108/56.1 |

*Primary Examiner*—Kenneth J. Dorner
*Assistant Examiner*—Gerald A. Anderson

[57] ABSTRACT

A lightweight, low-cost, structurally stable pallet or cargo shipping surface, composed of elements which are made primarily of layered and bonded corrugated cardboard material. The pallet elements include a base platform, a series of parallel base slats, an array of spacer blocks, a series of connecting intermediate slats, a series of top slats, and finally a top platform member. The corrugated cardboard elements are arranged in such a manner that the bonded layers of one element are, where possible, at right angles to the bonded layers of adjacent elements. The base slats and the top platform may alternatively be constructed of wood for certain applications. The structure allows access by standard pallet moving equipment from any side.

12 Claims, 2 Drawing Sheets

CORRUGATED CARDBOARD PALLET

CROSS REFERENCES TO RELATED APPLICATIONS

This application is a Continuation in Part of application Ser. No. 07/567,301, filed Aug. 14, 1990, now U.S. Pat. No. 5,076,176.

BACKGROUND OF THE INVENTION

1. Field of the Invention

This invention relates generally to pallets and other structures designed to contain, support, and aid in the transport of cargo. This invention relates more specifically to such pallets and structures that are constructed primarily of corrugated cardboard.

2. Description of Related Art

Structurally sound pallets are essential tools in the cargo shipping industry throughout the world. Whether cargo is being shipped by land, sea, or air, the handling of material necessitates the use of a practical means of supporting and moving unit amounts of goods.

The most common form of the shipping pallet is constructed of wood and is configured in one of two basic designs A first wooden pallet design is constructed of 2"×4" wooden members, three to a pallet, which are laid parallel, on edge, and are cross connected by a series of 1"×4" or 1"×6" slats which form the top surface of the pallet.

A second wooden pallet design is constructed of nine or more discrete wooden blocks which function as spacers between two layers of parallel flat wooden slats. The advantage of this latter configuration is that it is approachable by a fork lift or other standard pallet moving device from any of its four sides. The 2"×4" design on the other hand is approachable only from two sides that are opposite each other across the pallet.

The disadvantages of both wooden pallet designs derive primarily from the fact that they are constructed of wood.

A first disadvantage is the fact that wooden pallets are typically very costly. Not only is the wood product itself expensive, but the configuration and construction of the pallet is complex and costly as well. Wood continues to become a scarcer and more valuable commodity, and recent concerns over the availability of harvestable trees have only increased wood's value and have spurred society's move towards substitute materials.

A second disadvantage derives from the fact that wooden pallets have the potential for damaging a finished surface that the pallets might be used upon. In addition to the wooden members themselves being a problem, the nails used in the construction of most wooden pallets are also likely to cause damage. It is nearly impossible for someone utilizing a wooden pallet on a sensitive surface to move cargo without causing some damage to that surface.

A third disadvantage to wooden pallets relates to their potential for damaging the cargo that is placed upon them. The same defects, splinters, and nails, that can damage floor surfaces can also be found on the support platforms of wooden pallets and can easily catch and cut into cargo being transported.

A fourth disadvantage of wooden pallets relates to their excessive weight. Whether the construction is of the 2"×4" design or the wooden block design, the heavy weight of the typical wooden pallet limits the ability of an individual to carry one, or at most two pallets when empty. Furthermore, while the cargo being transported on a pallet typically outweighs the pallet by a significant amount, the weight of a wooden pallet is substantial enough to be an important factor when determining the overall weight of a load being shipped.

In spite of their disadvantages, wooden pallets do have the advantage of being reusable for a certain period of time or for a certain number of cycles of use. Inevitably, however, a wooden pallet will be damaged to the point that it can no longer safely transport cargo. At such a point, the damaged pallet becomes a disposal problem and can frequently end up occupying a large amount of space in disposal landfills.

It is estimated that over half of all shipping pallets are not returned to their point of origin after use. This means that the shipper must continuously buy new or used replacement pallets and to a great extent relies on the general circulation of used wooden pallets to provide a supply that is more cost effective than merely the purchasing of an unused new wooden pallet. Relying on this uncertain supply can be costly if a shipper's demand for pallets does not coincide with the arrival of a corresponding supply of used pallets. If a pallet user could rely on a constant supply of inexpensive pallets that did not fluctuate with the availability of recycled used pallets, it would certainly be to his advantage.

Cardboard pallets have been conceived of and utilized for quite some time as an alternative to wooden pallets. Cardboard pallet designs that have been used in the past have solved many of the above described problems associated with wooden pallets.

Cardboard pallets are typically very cost efficient. The wood pulp that is the basic component of the cardboard material is less expensive than the structural wood components of a typical wooden pallet. Most all cardboard products are recyclable so the raw material for a cardboard pallet could come from recycled sources and the cardboard pallet itself could be recycled.

Cardboard pallets may be used on surfaces that would otherwise be subjected to damage by wooden pallets. Cardboard pallets have a softer impact on both the surfaces they are placed upon and the cargo that is placed upon them.

Cardboard pallets are significantly lighter in weight than wooden pallets of similar size and design. A number of empty cardboard pallets could be easily handled by a single individual and the weight that a cardboard pallet adds to the overall weight of a cargo load is almost insignificant.

Some cardboard pallet designs have the additional capacity to be reused. In the past, the number of use cycles for a cardboard pallet was limited, but optimizing a cardboard pallet's structural integrity can extend the number of use cycles in certain environments.

Also significant, is the fact that once a cardboard pallet is damaged beyond the point that it can be safely used, the pallet is not a disposal problem and can be recycled to create the raw material for additional cardboard pallets. Because of its recyclability and low cost, a cardboard pallet would more likely be turned in for recycling at an appropriate time. Because of their nonrecyclability and high cost, wooden pallets are frequently used beyond the point that they can safely or sufficiently handle cargo.

The problems associated with previous cardboard pallet designs have related primarily to their inability to hold up structurally as well as their wooden counterparts. There have likewise been problems associated with imitating the accessibility of the wooden pallet designs described above. It is, however, the lack of structural integrity that has to this point been the major barrier to a more widespread acceptance of the cardboard pallet.

Existing cardboard pallet designs are often limited to a very light load capacity. Their structural integrity generally deteriorates rapidly with use and usually restricts the pallet to a one time loading and unloading. For the most part, the structural soundness of a cardboard pallet has been directly related to its cost. Cardboard pallets that are capable of handling greater loads not only require a more complex construction and higher material costs, but also require significantly higher manufacturing costs. Cardboard pallets that approach a wooden pallet's structural integrity frequently have not only this disadvantage of additional cost, but have significant additional weight as well. Certainly, a solid slab of corrugated cardboard, the size and shape of a typical wooden pallet, could handle any load that a wooden pallet could handle. Unfortunately, such solid slabs of corrugated cardboard are impractical both from a cost perspective and from a handling and weight perspective. The required balance to be struck between structural integrity and cost and weight has heretofore not been met. No corrugated cardboard pallets have been able to optimize all of these factors.

SUMMARY OF THE INVENTION

It is therefore an object of the present invention to provide a pallet made primarily of cardboard of sufficient structural integrity to be a substitute, in appropriate circumstances, for the standard wooden pallet.

It is another object of the present invention to provide a pallet made primarily of corrugated cardboard that is characterized by its structural integrity and that allows for access by lifting devices from any side.

It is another object of the present invention to provide a pallet made primarily of corrugated cardboard capable of supporting the loads more typically found used in conjunction with wooden pallets.

It is another object of the present invention to provide a pallet made primarily of corrugated cardboard that is capable of maintaining its structural integrity in an environment that may expose the surface of the pallet to moisture.

It is another object of the present invention to provide a pallet made primarily of corrugated cardboard that is low in cost both in terms of materials expense and manufacturing expense.

It is another object of the present invention to provide a pallet that is made primarily of corrugated cardboard that is recyclable by means of shredding the bulk of the pallet and reconstructing new cardboard elements from the shredded material.

In satisfaction of these and related objectives, applicant's invention provides a pallet which is constructed primarily of layered and bonded sections of corrugated cardboard strategically placed on end and in orientations that provide a structural support imitative of wooden support members. Applicant's invention creates a pallet that in all respects performs to the standards of wooden pallets and overcomes the disadvantages of wooden pallets by way of its light weight, low cost and recyclability. Applicant's pallet design is constructed so as to allow access from more than a single direction and may incorporate appropriate sealants that will allow the cardboard pallet to come in contact with moisture without loosing its structural integrity.

DETAILED DESCRIPTION OF THE PREFERRED EMBODIMENT

Figure 1:
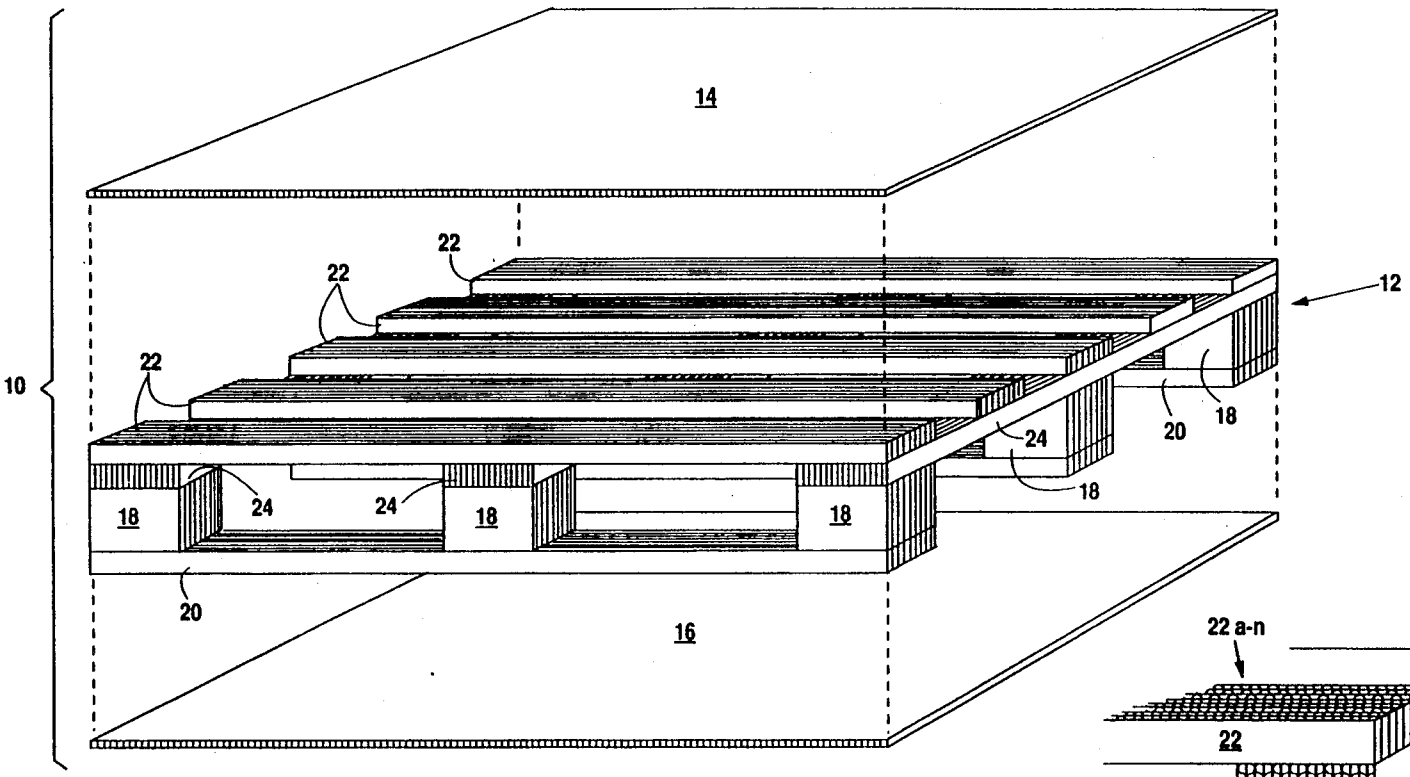
FIG. 1 is a partially exploded, perspective view of a preferred embodiment of applicant's corrugated cardboard pallet.

Referring first to FIG. 1, a partially exploded perspective view of a preferred embodiment, the fully assembled pallet is generally indicated by reference numeral 10. The fully assembled pallet is composed of three sections shown separated in this exploded view. The pallet frame is generally referred to by reference numeral 12. Top platform 14 and bottom platform 16, are shown removed from their positions on the fully assembled pallet 10.

Pallet frame 12 comprises a number of elements of layered and bonded corrugated cardboard material. These elements are themselves bonded together to form the structural frame 12.

Three base slats 20 are aligned parallel one to another and are spaced equally apart to act as base support members. To the top of each base slat 20 are bonded and mounted three spacer blocks 18. Spacer blocks 18 are themselves positioned one at each end of each base slat 20 with a third placed equidistant from each end of each base slat 20. The combination of base slats 20 and spacer blocks 18 provides a rectangular array of nine spacer blocks 18 organized generally in the form of a square with three rows by three columns. Atop these nine spacer blocks 18 are positioned three intermediate slats 24. Intermediate slats 24 lay across spacer blocks 18, each intermediate slat 24 connecting a total of three spacer blocks 18. Intermediate slats 24 serve to connect the array of spacer blocks 18 into a single unit by way of their placement perpendicular to base slats 20.

Finally, a plurality of top slats 22 are placed across intermediate slats 24 to further bind the overall framework and to provide a greater surface area upon which top platform 14 may be placed. In the preferred embodiment, there are five top slats 22 which are spaced evenly apart and are bonded to intermediate slats 24. Top slats 22 are placed in a direction perpendicular to intermediate slats 24.

Once the structural frame 12 of pallet 10 is completely formed, top platform 14, constructed of a single sheet of corrugated cardboard is bonded and attached to the upper surfaces of top slats 22. Bottom platform 16 which is also composed of a single sheet of corrugated cardboard is bonded and attached to base slats 20.

Figure 2:
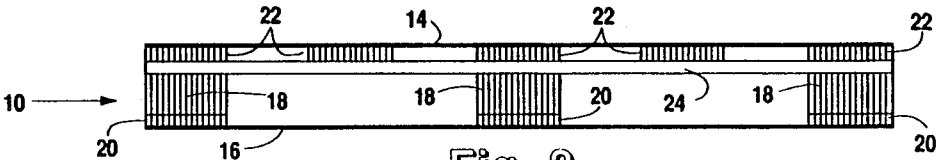
FIG. 2 is a side elevational view of the embodiment shown in FIG. 1.

Referring now to FIG. 2, a side view of the embodiment shown in FIG. 1, the spacing and elevation of the pallet components can be seen. Top platform 14 and bottom platform 16 have been positioned as they would normally be attached on pallet 10. Top slats 22 are seen edge on and are displaced equidistant apart with a top slat 22 along each edge of pallet 10 and with the spacing between each top slat 22 being approximately equal to the width of each top slat 22. Top slats 22 are shown supported by intermediate slats 24 with a single intermediate slat 24 shown across its side in the view in FIG. 2. Beneath intermediate slats 24 are three spacer blocks 18. Beneath spacer blocks 18 are base slats 20, with spacer blocks 18 mounted on each end thereof. Base slats 20 are seen edge on as they are generally parallel to top slats 22 in this embodiment.

Figure 3:
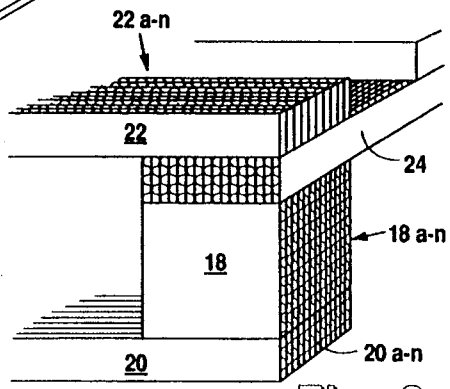
FIG. 3 is a detailed fragmentary view of one corner of the embodiment shown in FIG. 1.

FIG. 3 is a detailed fragmentary view of one corner of the embodiment shown in FIG. 1. In FIG. 3, spacer block 18 is shown positioned atop and bonded to one end of base slat 20. Intermediate slat 24 is positioned atop and bonded to spacer block 18. Finally, top slat 22 is positioned atop and bonded to intermediate slat 24.

In the detailed fragmentary view of FIG. 3, the orientation of the corrugated layers can be better seen. Corrugated layers 20*a–n* of base slat form a series of parallel, planar segments whose dimensions are defined by the length and the thickness of base slat 20. Spacer block 18 is composed of corrugated layers 18*a–n* which are planar segments that have dimensions equal to the height and width of spacer block 18. In this embodiment, the planar segments of spacer block 18 are aligned generally parallel to and coincident with the planer segments which define the corrugated layers 20*a–n* of base slat 20. Corrugated layers 24*a–n* which are bonded together to create intermediate slats 24 are, as with base slat 20, defined by planar segments whose dimensions are equal to the length and the thickness of intermediate slats 24. Finally, corrugated cardboard layers 22*a–n* which are bonded together to form top slats 22 are generally defined by planar segments which, as with bottom slats 20 and intermediate slats 24, have dimensions approximated by the length and the thickness of top slat 22. The planar segments 24*a–n* of intermediate slats 24 are positioned atop spacer blocks 18 with one dimension aligned with the planar segments 18*a–n* of spacer blocks 18, but with a second dimension at right angles with planar segments 18*a–n* of spacer blocks 18. Likewise, the orientation of the planer segments 22*a–n* comprising top slats 22 are oriented at right angles to intermediate slats 24 and are generally co-planar with planar segments 18*a–n* of spacer blocks 18 and the planar segments 20*a–n* of base slats 20. The arrangement of layers of corrugated cardboard shown in FIG. 3 provides the strongest structural support possible given the elements which comprise pallet 10. The three upper elements in the layers shown, namely top slats 22, intermediate slat 24, and spacer blocks 18 are all positioned by alternating the direction of the corrugated layers. Ideally, the bottom layer formed by base slats 20 would likewise be oriented at right angles to spacer blocks 18. However, the overall requirements of the structure demand that base slats 20 are aligned at right angles to intermediate slats 24 and are necessarily, therefore, positioned parallel to the planer segments 18*a–n* in spacer blocks 18.

Figure 4:
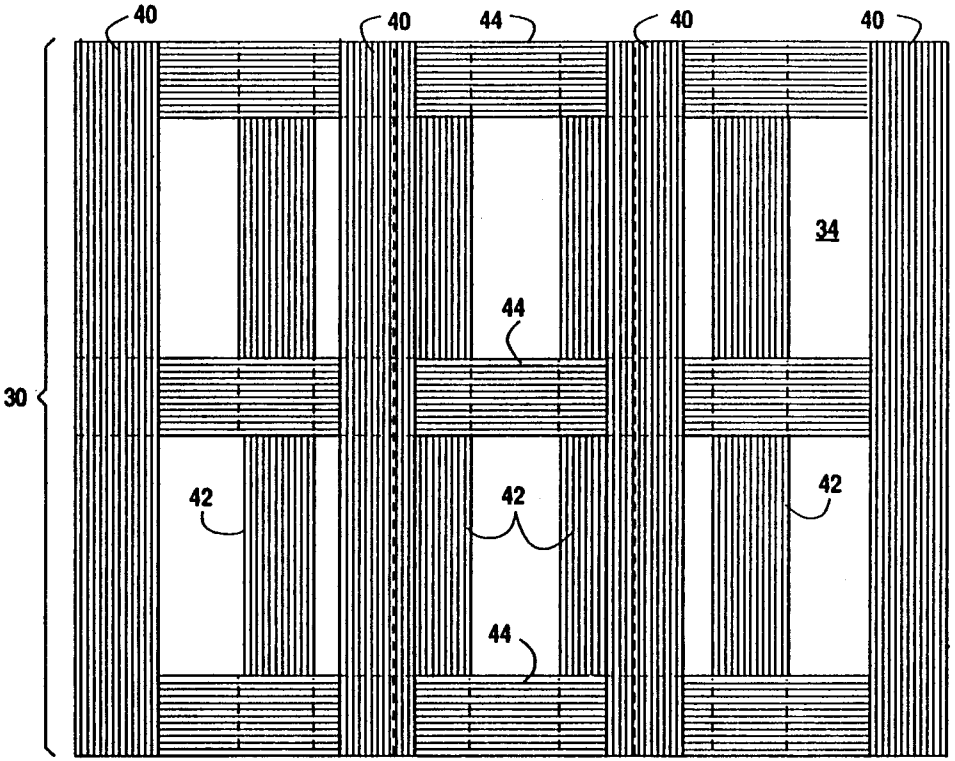
FIG. 4 is a bottom plan view of an alternative preferred embodiment of applicant's invention.

FIG. 4 is a bottom plan view of an alternative preferred embodiment of applicant's invention. Pallet 30 shown in FIG. 4, is a larger pallet with a greater overall surface area upon which cargo might be placed. The view in FIG. 4 discloses the arrangement of elements which structurally create pallet 30. Four base slats 40 are arranged parallel one to another and are spaced apart so as to form an arrangement upon which the balance of pallet 30 can be built. Not seen in FIG. 4, are spacer blocks 38 (shown in FIG. 5) which form an array of supports that are mounted to the top surfaces of base slats 40. The positions of spacer blocks 38 are generally seen as the intersections of base slats 40 and intermediate slats 44. Atop each spacer block 38 is mounted an intermediate slat 44. Intermediate slats 44 each connect a row of four spacer blocks 38 and thereby create a unitary structure which connects base slats 40 together. Intermediate slats 44 are directed perpendicular to base slats 40 and, in the preferred embodiment, are three in number so as to cover the entire array of twelve spacer blocks 38.

Finally, a plurality of top slats 42 are placed perpendicularly across intermediate slats 44 to provide a top surface on which is placed and bonded top platform 34. As in the previous embodiment, top slats 42 are positioned and spaced so that there is one along each of two edges of the top surface of pallet 30 with the balance spaced between these edge top slats 42 at distances from each other approximately equal to the width of each top slat 42. Portions of the underside of top platform 34, which is a single sheet of corrugated cardboard, can be seen between the structural members that form the framework of pallet 30.

Figure 5:
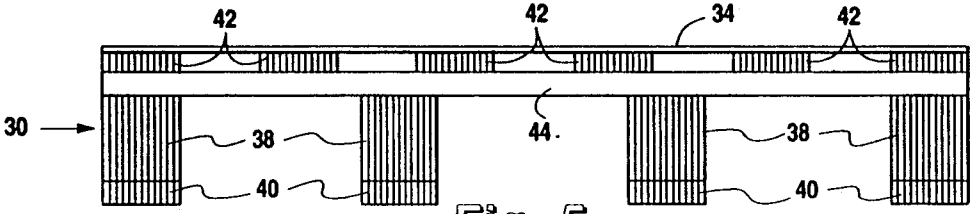
FIG. 5 is a side elevational view of the alternative embodiment shown in FIG. 4.

Referring now to FIG. 5, a side elevational view of the alternative embodiment shown in FIG. 4, the placement of spacer blocks 38 can be more readily seen. Again, base slats 40 provide the foundation upon which the balance of the structure of pallet 30 is built. Base slats 40 are seen on their edge in FIG. 5 and are shown with spacer blocks 38 attached and bonded to the top thereof. FIG. 5 discloses a single row of spacer blocks 38, this row being made up of four spacer blocks 38, there being three such rows to form an array of twelve spacer blocks 38. Intermediate slat 44 shown is one of four intermediate slats 44 which cross and connect the combination of spacer blocks 38 and base slats 40. Finally, atop intermediate slats 44, are seen top slats 42 in an edge on view with top platform 34 displaced across the entire surface formed by top slats 42.

Figure 6:
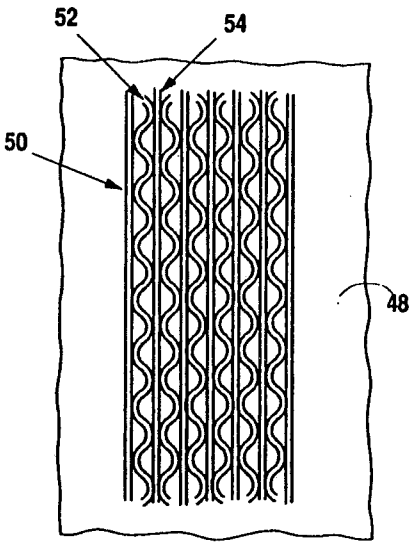
FIG. 6 is a detailed view of a typical section of corrugated layers in a preferred embodiment.

FIG. 6 is a detailed view of one embodiment of the corrugated layered construction. The embodiment in FIG. 6 discloses a section generally described as 48 that is representative of any of the layered and bonded corrugated cardboard elements. These layered and bonded corrugated elements may be constructed by alternating a layer of flat cardboard 50 with a layer of corrugated cardboard 52. In a preferred embodiment, this sequence is followed by a subsequent flat layer of cardboard 54. Another preferred embodiment not shown, could contain layers of corrugated cardboard that each comprise a flat, a corrugated, and a second flat cardboard layer. This would create a bonded section whose layers would follow: flat, corrugated, flat, flat, corrugated, etc. The particular layering configuration is not as important as is the overall orientation of these layers with respect to one another in the complete pallet.

The embodiment disclosed in FIG. 4 and 5 is constructed with bonding layers directed in the same planes as those seen in the embodiment of FIG. 1, 2, and 3. In fact, the detail shown in FIG. 3 is applicable to the embodiments of FIG. 4 and 5 as much as it is to that of FIG. 1 and 2. This above described cross hatching of corrugated layers provides the greatest strength possible given the structural configuration required by the pallet design.

A number of modifications are possible to either or both of the above described embodiments. The surface platforms 14 and 16 may be omitted from the manufacture of pallet 10 so that pallet 10 is comprised solely of the structural framework 12. The advantage of this configuration is a reduction in overall mass and therefore weight, but along with this advantage, is the disadvantage of having less shear stability. While platforms 14 and 16 add little to the vertical support or vertical structural stability of the pallet, the platform surfaces 14 and 16 do serve, when bonded to the appropriate structural elements, to prevent the structural deformity of the pallet when the pallet experiences shear stresses. The platform surface 14 is additionally advantageous when small and/or potentially loose articles of cargo are to be placed upon the surface of the pallet.

As the embodiment disclosed in FIGS. 4 and 5 indicates, it would also be appropriate to omit the base platform shown as 16 in the embodiment of FIGS. 1 and 2, so as to reduce weight while maintaining the upper platform 14 as both a structural and a cargo supporting member.

Every pallet element disclosed in the above description may, prior to its assembly, be coated and sealed with an appropriate water repellant sealant. Such a sealant would add minimally to the overall weight of the pallet and would allow pallet to be utilized in a moist environment. If it is not anticipated that the pallet will encounter a moist environment, the sealant may be dispensed with so as to decrease the overall cost and weight of the pallet.

The configurations shown in each of the embodiments are designed to allow for the easy access by standardized pallet moving machinery to any side of the pallet. From the direction shown in FIGS. 2 and 5, a pallet moving device which has wheels on the front ends of the prongs of a pallet fork may be inserted under the pallet with little or no obstruction. Other pallet moving machinery, such as a typical fork lift, may access each of the embodiments from either direction. Machinery of this type typically have a fork structure that allow access to a pallet either adjacent to the floor surface or slightly above the floor surface, as with the front side of the pallet arrangement shown in FIG. 1.

DETAILED DESCRIPTION OF AN ALTERNATIVE EMBODIMENT

While the preferred embodiment of the present invention is described above as being constructed entirely of corrugated cardboard material, alternative embodiments of the present invention are possible that utilize some minimal amounts of wood for certain components in specific applications. These alternative embodiments achieve most, if not all, of the same advantages described above with reference to pallets made entirely from cardboard.

One alternative embodiment incorporates wooden boards in place of corrugated cardboard material for base slats 20 shown in FIG. 1. The use of wood for base slats 20 does add some weight to the pallet but it eliminates the necessity, in some situations, of waterproofing the corrugated cardboard, and therefore eliminates the weight associated with the waterproofing substance. If it is anticipated that the loaded pallet might be placed onto a floor surface that is wet, the use of wooden base slats 20 prevents the deterioration of the pallet prematurely.

This same embodiment is also preferable where pallet moving machinery will likely expose the base of the pallet to a significant amount of localized or abrasive impact. Corrugated cardboard material can withstand significant pressures if these pressures are distributed over a broad area. In some situations however, base slats 20 may be subjected to repeated, localized impacts that could eventually undermine the pallet's structurally integrity. Some pallet conveyor systems for example expose a pallet to repeated contact with small metals rollers, metal bearings, or even metal chain linkages. Such conveyors can eventually tear into the corrugated base layer of a pallet and destroy its ability to hold cargo. The replacement of base slats 20 with wooden members eliminates the above described problem and at the same time only slightly increases the weight of the pallet.

In this alternative embodiment base slats 20 would still be bonded to spacer blocks 18 using a suitable adhesive. Thus, even though there exists the possibility of marring a sensitive surface with the wooden material, there are no nails to compound the problem.

A second alternative embodiment utilizes a thin sheet of plywood in place of corrugated cardboard for top platform 14. The reasons for making this substitution are basically the same as those for replacing base slats 20; repeated localized impacts. If the cargo to be shipped has characteristics that subject the top layer of the pallet to uneven pressures, it may be preferable to substitute a thin, rigid plywood sheet for the corrugated layer in order to maintain the structural integrity of the pallet. As with the substitution of base slats 20, the weight of the pallet is only slightly increased in order to gain significant advantages in certain situations where carbo characteristics are adverse to a corrugated top surface.

The above descriptions are not intended to limit applicant's invention but are intended as descriptions of preferred embodiments. Additional embodiments will be made clear from the attached drawing and from the following claim language.

I claim:

1. A pallet for facilitating the handling of cargo comprising:

a plurality of parallel base slats, each of said base slats having at op and a bottom, said base slats being constructed of wood;

a plurality of spacer blocks, each of said spacer blocks having atop and a bottom, said spacer blocks positioned in a rectangular array such that said bottoms of said spacer blocks are adjacent and bonded to said tops of said base slats, each of said spacer blocks being constructed of bonded layers of corrugated cardboard;

a plurality of parallel intermediate slats, each of said intermediate slats having a top and a bottom, said intermediate slats positioned such that said bottoms of said intermediate slats are adjacent and bonded to said tops of said spacer blocks, said intermediate slats being generally perpendicular to said base salts, each of said intermediate slats being constructed of bonded layers of corrugated cardboard directed perpendicular to said layers of corrugated cardboard of said spacer blocks;

a plurality of parallel top slats, each of said top slats having a top and a bottom, said top slats positioned such that said bottoms of said top slats are adjacent and bonded to said tops of said intermediate slats, said top slats being generally perpendicular to said intermediate slats, each of said top slats being constructed of bonded layers of corrugated cardboard directed perpendicular to said layers of corrugated cardboard of said intermediate slats;

a top platform, said top platform having a top and a bottom face, said top platform being positioned such that said bottom face is adjacent and bonded to said tops of said top slats.

2. The pallet of claim 1 wherein said base slats number three, said spacer blocks number nine, said intermediate slats number three, and said top slats number five.

3. The pallet of claim 1 wherein said base slats number four, said spacer blocks number twelve, said intermediate slats number three, and said top slats number six.

4. The pallet of claim 1 wherein said top platform is constructed of a layer of corrugated cardboard.

5. The pallet of claim 1 wherein said top platform is constructed of a sheet of plywood.

6. A pallet for facilitating the handling of cargo comprising:

a plurality of parallel base slats, each of said base slats having a top and a bottom;

a plurality of spacer blocks, each of said spacer blocks having a top and a bottom, said spacer block positioned in a rectangular array such that said bottoms of said spacer blocks are adjacent and bonded to said tops of said base slats, each of said spacer blocks being constructed of bonded layers of corrugated cardboard;

a plurality of parallel intermediate slats, each of said intermediate slats having a top and a bottom, said intermediate slats positioned such that said bottoms of said intermediate slats are adjacent and bonded to said tops of said spacer blocks, said intermediate slats being generally perpendicular to said base salts, each of said intermediate slats being constructed of bonded layers of corrugated cardboard directed perpendicular to said layers of corrugated cardboard of said spacer blocks;

a plurality of parallel top slats, each of said top slats having a top and a bottom, said top slats positioned such that said bottoms of said top slats are adjacent and bonded to said tops of said intermediate slats, said top slats being generally perpendicular to said intermediates slats, each of said top slats being constructed of bonded layers of corrugated cardboard directed perpendicular to said layers of corrugated cardboard of said intermediate slats; and a top platform, said top platform having a top and a bottom face, said top platform being positioned such that said bottom face is adjacent and bonded to said tops of said top slats, said top platform being constructed of a sheet of plywood.

7. The pallet of claim 6 wherein said base slats are constructed of bonded layers of corrugated cardboard, and said layers of corrugated cardboard of said spacer blocks are directed parallel to said layers of corrugated cardboard of said base slats.

8. The pallet of claim 6 wherein said base slats number three, said spacer blocks number nine, said intermediate slats number three, and said top slats number five.

9. The pallet of claim 6 wherein said base slats number four, said spacer blocks number twelve, said intermediate slats number three, and said top slats number six.

10. The pallet for facilitating the handling of cargo comprising:

a plurality of base slats, each of said base slats generally in the shape of a rectangular solid, each of said base slats having a length, a width, a thickness, and two ends, said length and said width defining a top face and a bottom face, said length and said thickness defining two side faces, said base slats positioned spaced and parallel one to another along said lengths with said bottom faces in coplanar relationship, each of said base slats being constructed of wood;

a plurality of spacer blocks, each of said spacer blocks generally in the shape of a cubic solid, each of said spacer blocks having a face, two opposing side faces, and a bottom face, said spacer blocks positioned spaced in a rectangular array such that said bottom faces of said spacer blocks are in contact with said top faces of said base slats, said spacer blocks positioned at each of said ends of said base slats and at least one intermediate point between said ends of said base slats, each of said spacer blocks being constructed of a plurality of bonded layers of corrugated cardboard, said layers of said spacer blocks being generally parallel to said two opposing side faces of said spacer blocks and to said two side faces of said base slats;

a plurality of intermediate slats, each of said intermediate slats generally in the shape of a rectangular solid, each of said intermediate slats having a length, a width, a thickness, and two ends, said length and said width of each said intermediate slat defining a top face and a bottom face, said length and said thickness of each said intermediate slat defining two side faces, said intermediate slats positioned spaced and parallel one to another along said lengths with said bottom faces of said intermediate slats in coplanar relationship, said intermediate slats positioned such that said bottom faces of said intermediate slats are in contact with said top faces of said spacer blocks and such that said lengths of said intermediate slats are generally perpendicular to said lengths of said base slats, each of said intermediate slats being constructed of a plurality of bonded layers of corrugated cardboard, said layers of said intermediate slats being generally parallel to said two side faces of said intermediate slats; and a plurality of to slats, each of said top slats generally in the shape of a rectangular solid, each of said top slats having a length, a width, a thickness, and two ends, said length and said width of each said top slat defining a top face and a bottom face, said length and said thickness of each said top slat defining two side faces ,said top slats positioned spaced and parallel one to another along said lengths of said top slats with said bottom faces of said top slats in coplanar relationship, said top slats positioned such that said bottom faces of said top slats are in contact with said top faces of said intermediate slats and such that said lengths of said top slats are generally perpendicular to said lengths of said intermediate slats, each of said top slats being constructed of a plurality of bonded layers of corrugated cardboard, said layers of said top slats being generally parallel to said two side faces of said top slats; and a top platform generally in the shape of a rectangle having a length and a width, said length and said width of said top platform defining a top face and a bottom face, said length of said top platform being approximately equal to said length of said top slats, said width of said top platform being approximately equal to said length of said intermediate slats, said top platform being positioned such that said bottom face of said top platform is in contact with said top faces of said top slats, said top platform positioned so as to cover said top faces of said top slats, said top platform being constructed of a sheet of plywood.

11. The pallet of claim 10 wherein said layers of corrugated cardboard comprise a corrugated sheet of cardboard material bonded between two flat sheets of cardboard material.

12. The pallet of claim 10 wherein said layers of corrugated cardboard comprise a corrugated sheet of cardboard material bonded to a single flat sheet of cardboard material.

* * * * *